US009771742B1

(12) United States Patent
Reed et al.

(10) Patent No.: US 9,771,742 B1
(45) Date of Patent: Sep. 26, 2017

(54) REMOTE CONTROLLED RETRACTABLE LEG RESTRAINT DEVICE

(71) Applicants: Lee A. Reed, Jackson, MS (US); Richard Renehan, Manchester, MA (US)

(72) Inventors: Lee A. Reed, Jackson, MS (US); Richard Renehan, Manchester, MA (US)

(73) Assignee: Advanced Restraint Systems LLC, Manchester, MA (US)

( * ) Notice: Subject to any disclaimer, the term of this patent is extended or adjusted under 35 U.S.C. 154(b) by 0 days.

(21) Appl. No.: 15/596,167

(22) Filed: May 16, 2017

Related U.S. Application Data

(60) Provisional application No. 62/341,175, filed on May 25, 2016.

(51) Int. Cl.

| | |
|---|---|
| ***E05B 75/00*** | (2006.01) |
| ***B65H 75/44*** | (2006.01) |
| ***B65H 75/48*** | (2006.01) |
| ***F41H 13/00*** | (2006.01) |

(52) U.S. Cl.
CPC ..... *E05B 75/00* (2013.01); *B65H 75/4486* (2013.01); *B65H 75/48* (2013.01); *F41H 13/0025* (2013.01); *Y10T 70/404* (2015.04)

(58) Field of Classification Search
CPC ..... E05B 75/00; B65H 75/4486; B65H 75/48; F41H 13/0025; Y10T 70/404
USPC ..... 70/15–17; 119/802, 803, 857; 128/878, 128/879, 882
See application file for complete search history.

(56) References Cited

U.S. PATENT DOCUMENTS

| | | | | | |
|---|---|---|---|---|---|
| 3,545,237 | A * | 12/1970 | Gardella, Jr. | E05B 75/00 | 70/16 |
| 4,024,736 | A * | 5/1977 | De Michieli | E05B 75/00 | 70/16 |
| 4,089,195 | A * | 5/1978 | Lai | E05B 75/00 | 361/232 |
| 4,811,775 | A * | 3/1989 | Sun | E05B 75/00 | 361/232 |
| 5,099,662 | A * | 3/1992 | Tsai | E05B 75/00 | 70/16 |
| 5,841,622 | A * | 11/1998 | McNulty, Jr. | F41H 13/0018 | 361/232 |
| 6,026,661 | A * | 2/2000 | Spiropoulos | E05B 75/00 | 242/388 |
| 6,360,747 | B1 | 3/2002 | Velarde et al. | | |

(Continued)

*Primary Examiner* — Lloyd Gall
(74) *Attorney, Agent, or Firm* — Anthony D. Pellegrini

(57) ABSTRACT

A remote controlled retractable leg iron device provides a restraint device which can be used by police or any other authority to maintain control of persons while in transport. The device is remote controlled so an operator can control the wearer from a distance. The cuffs are secured to the legs of the wearer and are attached to the housing unit by cables which coil around winch drums within the housing unit. The winch drums rotate freely in a normal operation mode so that the wearer can walk or move with little resistance. In an emergency mode, the device retracts the wire cables into the housing unit so that the wearer's legs are restrained tightly together—removing the lack of resistance and thus stopping the wearer's motion. The emergency mode is activated using the remote control.

26 Claims, 8 Drawing Sheets

(56) References Cited

U.S. PATENT DOCUMENTS 6,615,622 B2 * 9/2003 MacAleese ..... E05B 75/00 463/47.4
7,000,439 B2 * 2/2006 DiDomenico ..... B60R 99/00 128/846
7,210,317 B2 5/2007 Beane et al.
7,712,200 B2 * 5/2010 Squires ..... A47C 7/62 128/879
8,397,545 B1 * 3/2013 Lash ..... E05B 75/00 70/16
8,578,742 B2 * 11/2013 Shulman ..... E05B 75/00 254/278
8,839,796 B2 * 9/2014 Reese ..... E05B 75/00 128/875
8,890,689 B2 * 11/2014 Ezzo ..... E05B 73/0017 340/539.11
2002/0166350 A1 * 11/2002 MacAleese ..... E05B 75/00 70/16
2005/0039499 A1 * 2/2005 Didomenico ..... B60R 99/00 70/16
2005/0193782 A1 * 9/2005 Beane ..... E05B 63/0056 70/16
2006/0272366 A1 * 12/2006 Kim ..... E05B 75/00 70/16
2008/0047307 A1 * 2/2008 Kenney ..... E05B 75/00 70/16
2009/0151401 A1 * 6/2009 Phanstiel ..... A61F 5/3715 70/16
2009/0211316 A1 * 8/2009 Butler ..... E05B 43/00 70/16
2010/0031709 A1 2/2010 Kim et al.
2011/0232338 A1 * 9/2011 Huang ..... E05B 75/00 70/16
2012/0085135 A1 * 4/2012 Louden ..... E05B 75/00 70/16
2012/0118027 A1 * 5/2012 Shulman ..... E05B 75/00 70/16
2012/0222457 A1 * 9/2012 Kriesel ..... E05B 75/00 70/16
2013/0067966 A1 * 3/2013 Wheeler ..... E05B 67/003 70/15
2014/0131435 A1 * 5/2014 Harrington ..... G06F 17/30725 235/375
2014/0260440 A1 * 9/2014 Lash ..... A01K 27/009 70/16
2014/0355167 A1 * 12/2014 Reese ..... E05B 75/00 361/232
2016/0083980 A1 * 3/2016 Lash ..... E05B 75/00 70/17

* cited by examiner

REMOTE CONTROLLED RETRACTABLE LEG RESTRAINT DEVICE

CROSS-REFERENCE TO RELATED APPLICATIONS

This application claims priority to a provisional application, U.S. Ser. No. 62/341,175, filed May 25, 2016, entitled Remote Controlled Retractable Leg Iron, by Lee A. Reed, et al., which is hereby incorporated by reference.

BACKGROUND OF THE INVENTION

The invention relates generally to leg restraint irons. In particular, the invention is related to a retractable leg restraint device which is controlled by a remote control. Leg irons are commonly known in the art and are often used by police and other authorities to restrain prisoners or inmates so that the prisoner or inmate is restricted from running or escaping. However, existing leg irons are limited in that the chain or wire connecting the cuffs have a fixed length. The length of this chain or wire has to be long enough to permit the prisoner to walk. However, this length also allows prisoners to escape as the movement of their legs is only partially restricted. A retractable leg iron which can be controlled by remote control solves this problem by making the length of the chain or wire adjustable so that the leg irons can have a sufficient length for movement when the prisoner is being transported but can actively be shortened for transport to prevent incidents or should the prisoner attempt to escape or need to be controlled.

SUMMARY OF THE INVENTION

Accordingly, the invention is directed to retractable leg irons which are controlled by a remote control unit. The remote controlled retractable leg irons prevent escapes by severely limiting the stride of the wearer, making running impossible and walking very difficult. They give any officer complete control over the mobility and movement of an inmate while in transport. When the remote is activated, and the emergency remote button is pushed, the remote controlled retractable leg irons start retracting the chains or cables, pulling the legs and feet of the wearer together, limiting the person's movement and mobility. The escapee is forced to stop the flight attempt, and officers are able to safely regain control.

The remote controlled retractable leg irons increase officer reaction time to prevent an incident or an escape. By restricting movement of the prisoner, the remote controlled retractable leg irons reduce the need for use of more elevated force measures. Finally, unlike conventional leg irons, due to its retractable capabilities, the device allows for easier movement of the wearer when not in emergency mode, and the device is easy to store away without bulky chains hanging over.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWING

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Referring now to the invention in more detail, the invention is a remote controlled retractable leg iron 10.

Figure 1:
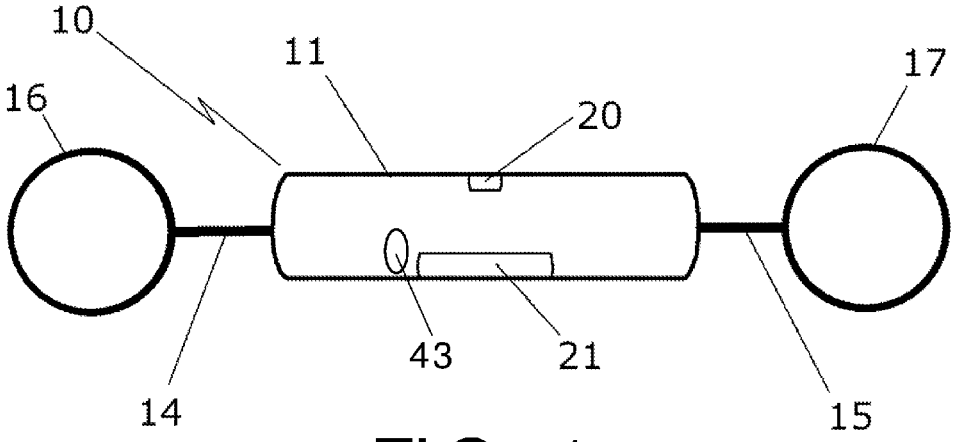
FIG. 1 shows a front view of the retractable leg irons, displaying the housing unit, the battery cover, the remote sensor window, the wires, and the cuffs.
Figure 2:
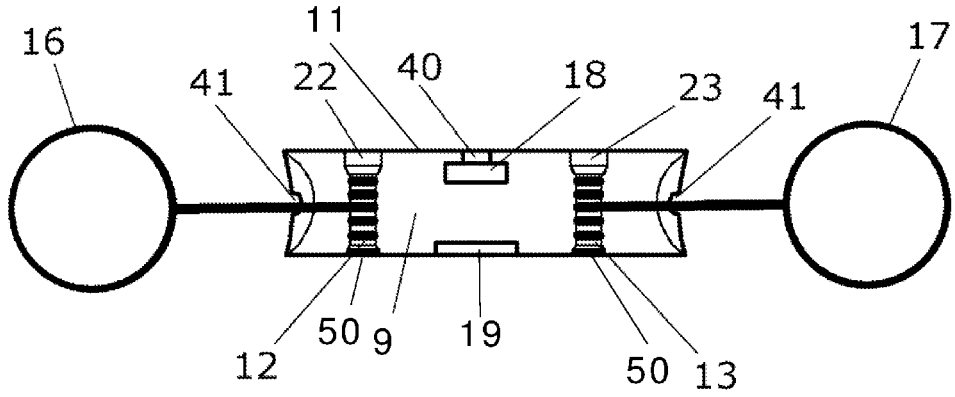
FIG. 2 shows a front interior view of the retractable leg irons, displaying the housing unit, the power source, the remote sensor, the control unit, the servomotors, the winch drums, the wires, and the cuffs.

The first exemplary embodiment provides a housing unit 11. See FIG. 1. The housing unit 11 is preferably cylindrical in shape, has a hollow interior 9, and provides circular apertures 41 at each end, though other shapes and configurations will also work. The housing unit 11 must be rugged; preferably, it is made of an alloy for strength and light weight, such as magnesium alloy, though other materials, such as aluminum, carbon fiber composites, and the like may be used. Within the housing unit 11 is a retraction means. In one embodiment, the retraction means comprises a left winch drum 12 and a right winch drum 13. See FIG. 2. The winch drums 12,13 are preferably mounted in a vertical position. Cable guides may be associated with the winch drums 12,13 to avoid tangling during retraction. Attached to the left winch drum is a left cable 14 and attached to the right winch drum 13 is a right cable 15. The cables 14,15 can be manufactured from any suitable material, such as titanium steel rope wire, flexible sheet metal, galvanized steel, carbon fiber, reinforced webbing, etc. Opposite the ends of each cable 14,15 that are attached to the winch drums 12,13 are a pair of cuffs 16,17. The cuffs 16,17 are preferably standard hand/leg cuffs with a pawl locking mechanism such that the cuffs can be securely fastened around the lower leg of the wearer.

Figure 4:
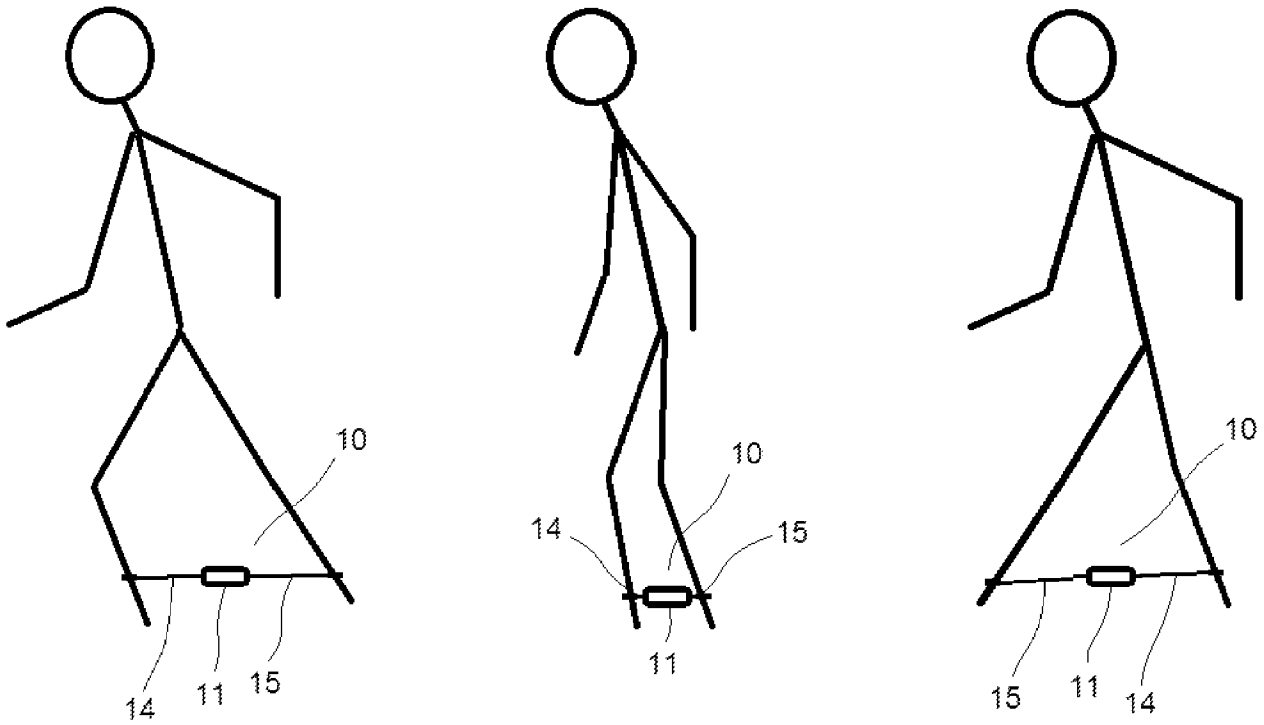
FIG. 4 shows a stylized view of a wearer of the device in motion, during normal operating mode; as the legs come closer together mid-stride, the device automatically retracts, and as the stride lengths out, the cables extend out from the housing unit once more.
Figure 5:
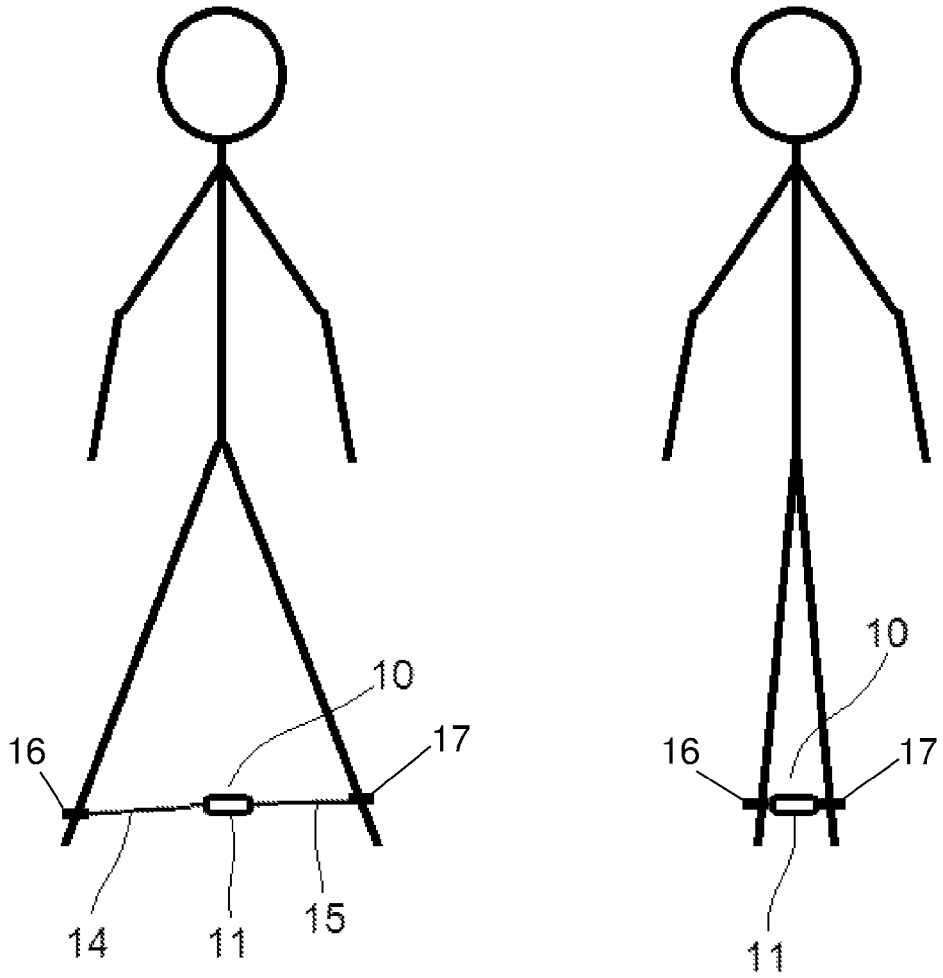
FIG. 5 shows a stylized view of a wearer of the device depicted in FIG. 4, first with the device in extended mode, with the cables extended from the housing unit, and then with the device in closed mode, with the cables retracted within the housing unit and the cuffs positioned adjacent to the housing unit.

In a closed position, the cables 14,15 are coiled around their respective winch drums 12,13 until the cuffs 16,17 rest against the circular apertures 41 on the ends of the housing unit 11, and the winch drums 12,13 are locked in position and do not rotate. When in a normal operation mode the retractable leg irons are free to move into an extended position. In the extended position, the winch drums 12,13 freely rotate so that the cables 14,15 are free to extend outward from the housing unit 11 and automatically retract into the housing unit 11 whenever there is slack on the cables 14,15, similar in function to a centrifugal clutch mechanism that provides the automatic retraction function of a seatbelt. When the cables 14,15 retract into the housing unit 11, each cable 14,15 is coiled around the respective winch drum 12,13 and when extending from the housing unit 11, each cable 14,15 is uncoiled from the respective winch drum 12,13. See FIGS. 4 and 5.

In an alternative embodiment of the device 10, a single winch drum is used. The ends of the cables 14,15 are each attached to the single winch drum. Rotation of the single winch drum in one direction winds the cables 14,15 around the single winch drum, and rotation of the single winch drum in the opposite direction unwinds the cables 14,15 from the single winch drum.

Figure 6:
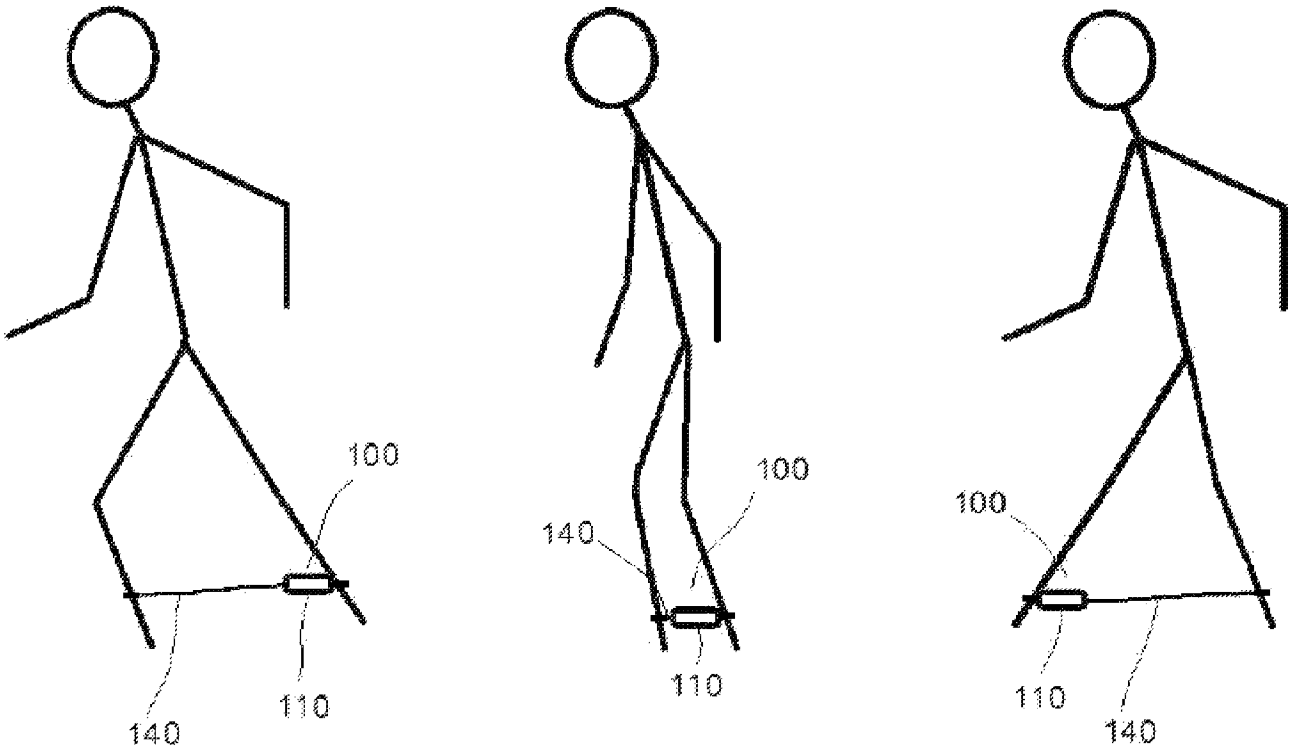
FIG. 6 shows a stylized view of a wearer of an alternative embodiment of the device in motion, during normal operating mode; as the legs come closer together mid-stride, the device automatically retracts, and as the stride lengths out, the single cable extends out from the housing unit once more.
Figure 7:
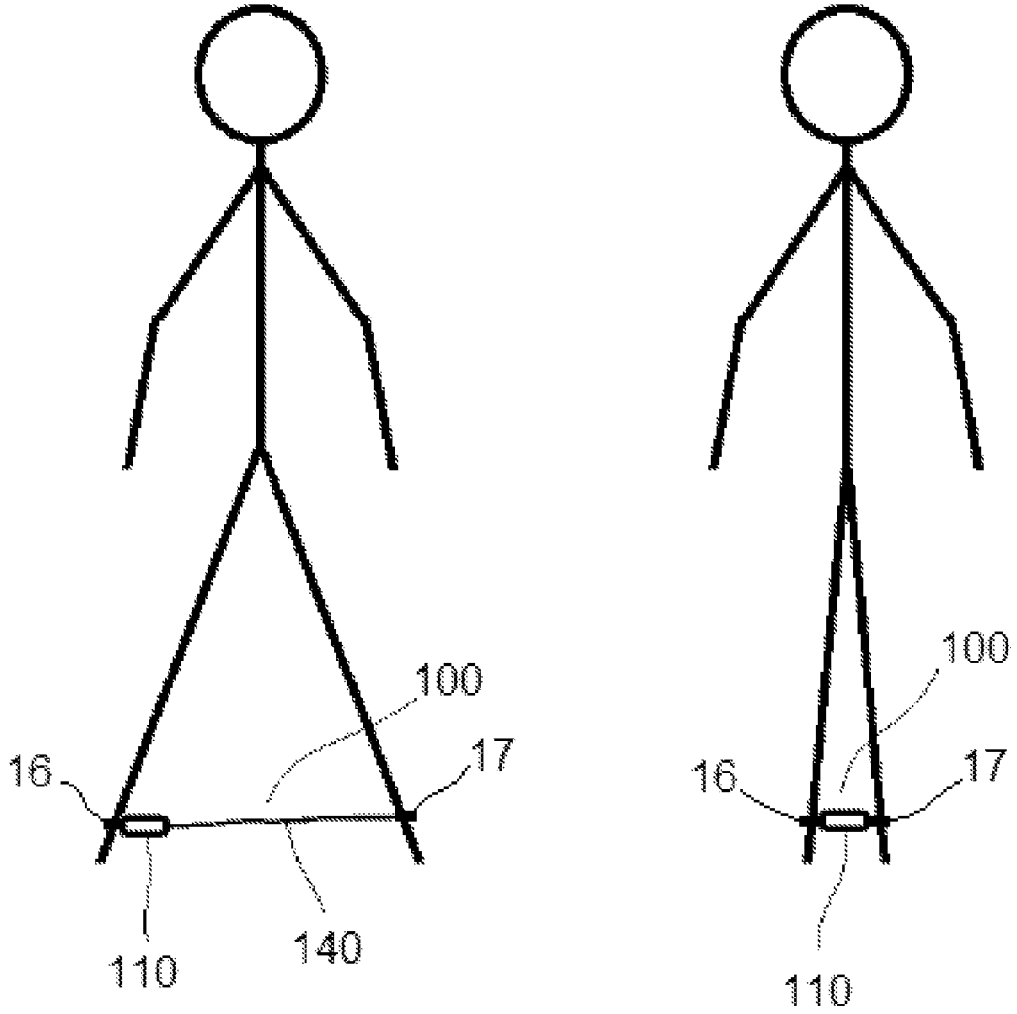
FIG. 7 shows a stylized view of a wearer of the device depicted in FIG. 6, first with the device in extended mode, with the single cable extended from the housing unit, and then with the device in closed mode, with the cable retracted within the housing unit and the first cuff positioned adjacent to the housing unit.

In yet another an alternative embodiment of the device 100, a single cable 140 is used, with a winch drum located within the housing unit 110. The first end of the cable 140 is attached to the winch drum, and the second end of the cable 140 is attached to the second cuff 17. The first cuff 16 is attached to the housing unit 110. Rotation of the winch drum in one direction winds the cable 140 around the winch drum, and rotation of the winch drum in the opposite direction unwinds the cable 140 from the winch drum. See FIGS. 6 and 7.

Figure 8:
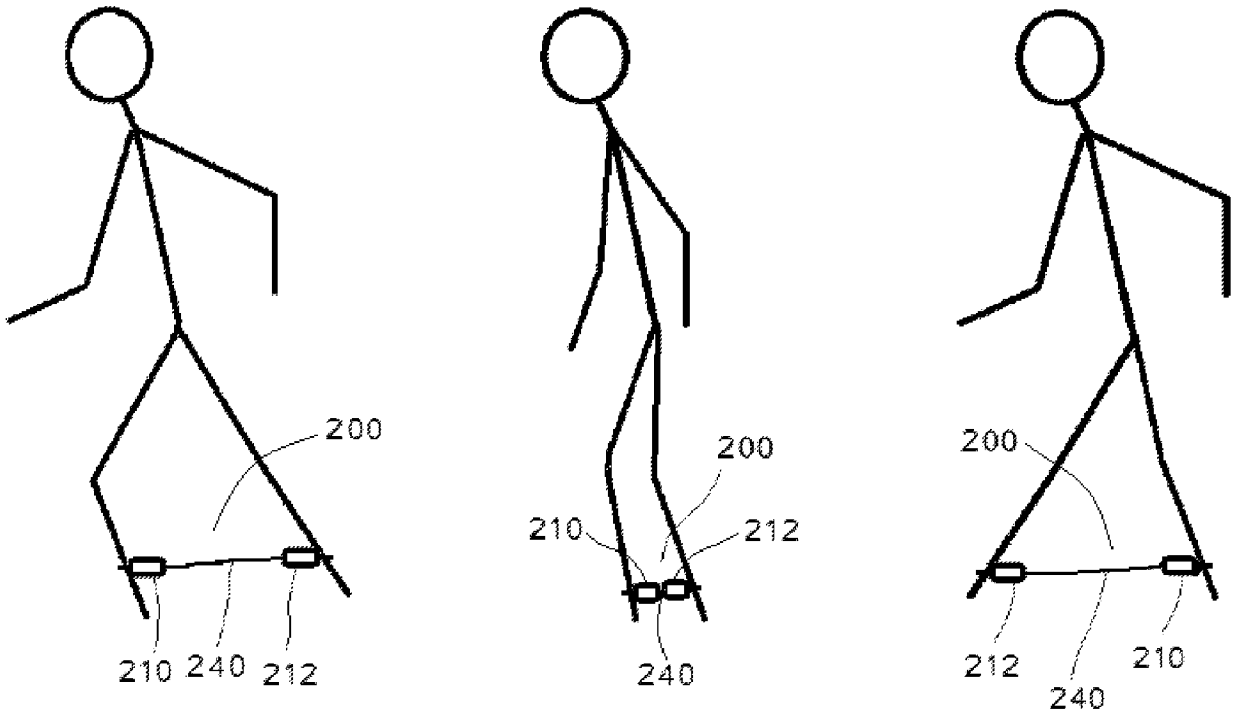
FIG. 8 shows a stylized view of a wearer of yet another alternative embodiment of the device in motion, during normal operating mode; as the legs come closer together mid-stride, the device automatically retracts, and as the stride lengths out, the single cable extends out from the first and second housing units once more.
Figure 9:
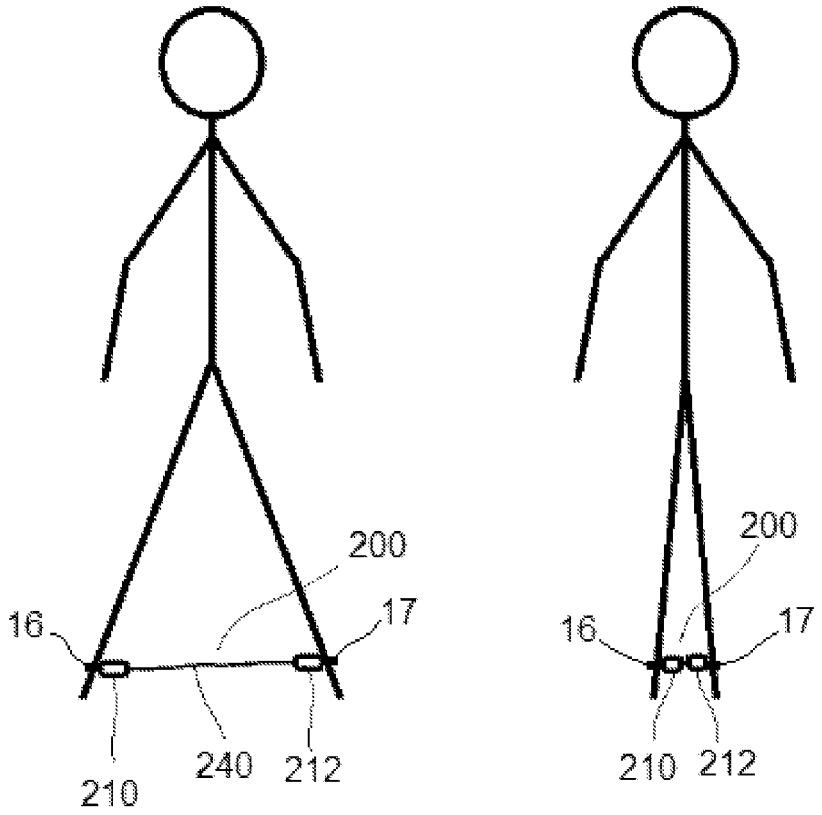
FIG. 9 shows a stylized view of a wearer of the device depicted in FIG. 8, first with the device in extended mode, with the single cable extended from the first and second housing units, and then with the device in closed mode, with the cable retracted within the first and second housing units.

In yet another an alternative embodiment of the device 200, a single cable 240 is used with a first housing unit 210 and a second housing unit 212. Within each housing unit 210,212 is a single winch drum. The first end of the cable 240 is attached to the winch drum located in the first housing unit 210, and the second end of the cable 240 is attached to the winch drum located within the second housing unit 212. The first cuff 16 is attached to the first housing unit 210 and the second cuff 17 is attached to the second housing unit 212. Rotation of the winch drums in a first winding direction winds the cable 240 around the respective winch drums, and rotation of the winch drums in the opposite second unwinding direction unwinds the cable 240 from the respective winch drums. See FIGS. 8 and 9.

The housing unit 11 further provides a sensor 40. The sensor 40 is capable of receiving a signal from a remote control unit 30 and communicating that signal to a control unit 18. The sensor 40 is preferably located on the top edge of the housing unit 11 and is embedded within the housing unit 11 below a window 20. The control unit 18 may be a micro processor having logic control. In one embodiment it is manifest as a programmable multi-function printed circuit board. The control unit 18 is powered by a battery pack 19 contained within the housing unit 11. The battery pack 19 is preferably removable from the housing unit 11 and is accessible through a removable battery door 21. To prevent easy access to the battery pack 19 the battery door 21 may be secured by screws or other fasteners requiring tools for removal. The housing unit 11 may have a charging port 43 in communication with the battery pack 19 if the battery pack 19 comprises rechargeable batteries. In the embodiments of the invention where multiple housing units 210,212 are used, each comprises a sensor, a control unit, and a battery pack, as described herein.

The housing unit 11 further provides a means of actively retracting the cables 14,15. The means of actively retracting the cables 14,15 is preferably a set of electric servomotors 22,23 which are attached to the winch drums 12,13. The servomotors 22, 23 are in connection with and controlled by the control unit 18 and are powered by the battery pack 19. In the emergency mode, the servomotors 22,23 rotate the winch drums 12,13 in the direction which coils the cables 14,15 around the winch drums 12,13 until the retractable leg irons 10 are in the closed position (i.e., the cuffs 16,17 are resting against the apertures 41 at the ends of the housing unit 11). The winch drums 12,13 are then locked into place so that the cables 14,15 cannot extend outward from the housing unit 11. This may be accomplished in any number of known ways, for example, by having an actuator move a pin into and aperture in the winch drum, thereby preventing rotation. In the embodiment using a single winch drum, a single servomotor may be used. In the embodiments of the invention where multiple housing units 210,212 are used, each comprises a servomotor.

In one embodiment of the device, the servomotors 22,23 are located proximate to the winch drums 12,13, in a vertical orientation. Each servomotor 22,23 has a central axle which rotates when said servomotor is activated. Attached to the axle is a pulley, with the pulley oriented horizontally, at a substantially perpendicular orientation to the axle. A belt drive runs from the pulley to the winch drum. When the servomotor is activated, the axle rotates, thereby rotating the pulley and causing the belt drive to rotate the winch drum. Other configuration of the servomotor and its relationship to the winch drum are also contemplated.

The device may have an automatic retraction function, whereby the cables 14,15 automatically retract into the housing unit 11 in the absence of any force applied to extend the cables 14,15 from the housing unit 11. This improves the wearability of the device, whereby when the wearer takes a stride, as the wearer's legs come closer together excess length of the cables 14,15 is automatically retracted into the housing unit 11, and as the wearer's legs move apart from each other the cables 14,15 extend from the housing unit 11. This minimizes the potential for tripping while walking with the device. Note that this automatic retraction function is separate from the active retraction function that employs the servomotors 22,23 to forcibly retract the cables, notwithstanding any action by the wearer to avoid retraction. In order for the automatic retraction feature to work, the retraction means employs a biasing mechanism 50. In one embodiment, the biasing mechanism 50 is associated with the winch drums 12,13. Each winch drum comprises an element of the biasing mechanism 50 that rotates that winch drum in the first winding direction when there is no tension on the associated cable. The biasing mechanism 50 may be a pair of coil tension springs located at the top and bottom of the winch drum which rotate the winch drum in the first winding direction, thereby retracting the cable. These coil springs are easily overcome by the application of a fairly minor force, causing the winch drum to rotate in the second unwinding direction, thereby extending the cable from the housing unit. This mechanism is similar to that found on an automobile safety belt, where forward movement of the wearer allows the safety belt to extend, and rearward movement of the wearer allows the safety belt to automatically retract. It is also similar to the mechanism that allows a tape measure to be easily pulled from its housing, and then to automatically retract thereinto.

In yet another embodiment of the device, active retraction of the cables 14,15 is performed by combining the automatic retraction function described above with a one-way rotation locking mechanism. That is, as before, whenever there is slack in the cables 14,15 the biasing mechanism 50 retracts the cables 14,15, but in this mode the winch drums 12,13 rotate only in the first winding direction. Regardless of any force applied to the cables 14,15 in an attempt to extract them from the housing unit 11, the winch drums 12,13 will not rotate in the second unwinding direction. This is accomplished, for example, by having a moveable pin which is engageable with the winch drum, similarly configured to a typical ratchet mechanism. When the pin is disengaged, the winch drums 12,13 are free to rotate in either direction, but when engaged the winch drums 12,13 rotate only in the first winding direction. Engagement is affected by the remote control unit 30. While this embodiment provides for a slower retraction process (the wearer has to bring the legs together), it has the advantage of not requiring powered servomotors. And while the wearer can maintain leg separation to prevent retraction, such a posture is not conducive to escape.

The retractable leg irons 10 may also provide a means of shocking the wearer of the device. In shock mode, the control unit 18 may send a predetermined amount of electrical current through the cables 14,15 and cuffs 16,17, applying a shock to the wearer of the device. The control unit 18 preferably tracks and records the amount of time that a shock is administered to the wearer of the device. In this embodiment, the cables 14,15 and cuffs 16,17 are made of an electrically conductive material. In the embodiments of the invention where the cuffs 16,17 are fixedly attached to the housing units (for example, where multiple housing units 210,212 are used), the cable 240 need not be electrically conductive, as the electrical current will flow from each housing unit 210,212 directly to the cuffs 16,17.

Figure 3:
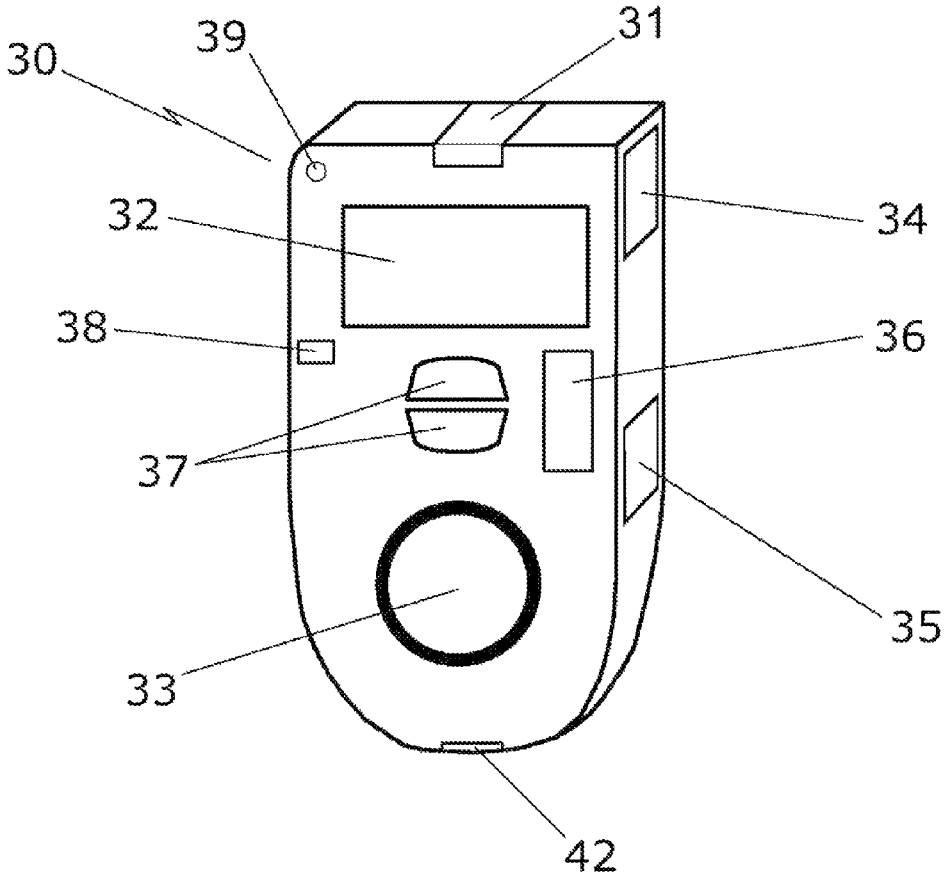
FIG. 3 shows a perspective view of the remote control, displaying the remote housing, the digital display, the transmitter, the power button, the voltage adjustment button, the reset button, the emergency button, the shock button, and the charging port.

The retractable leg irons 10 may further comprise a remote control 30 having a rechargeable battery and a charging port 42 in communication with the rechargeable battery. See FIG. 3. The remote control 30 provides a means for actively retracting the cables 14,15 of the retractable leg irons 10. At the very least, the remote control 30 is capable of switching the mode of the retractable leg irons 10 between the normal operation mode described above and the emergency mode described above. To do this, in one embodiment the remote control provides a transmitter 31 preferably located on a top edge of the remote control 30 and an emergency activation button 33. In addition to the emergency activation button 33, the remote control 30 may also provide any of the following buttons and functions: a remote power button 34 (for activating the remote); a shock power button 35 (for enabling the shock feature of the device); an emergency shock button 36 (for activating the shock mode of the device); adjustment control buttons 37 (for adjusting the voltage level of the shock feature); a lock/unlock button for use when the device is not in emergency mode; and/or a reset button 38 (for resetting the shock settings to zero).

A more advanced remote control 30 may be provided which further comprises a digital screen 32. The digital screen 32 may provide additional information about the device such as: the voltage setting for the shock mode, the current mode the device is in, the amount of time a shock was applied, whether the shock mode is enabled or not, or any other relevant information about the system. In yet another embodiment, a single remote control 30 may be programmed to operate several devices. In still another embodiment, the remote control 30 may be represented as an application ("APP") on a smart phone, tablet, or computer.

The device may have other optional features. In one embodiment the housing unit 11 further comprises a plurality of wheels located on the bottom of the housing unit 11. The wheels prevent the housing unit from dragging on the ground while being worn. In another embodiment, the housing unit 11 further comprises one or more indicator lights, to provide a visual indicator that various features of the device are operational. The one or more indicator lights may be LED lights, they may be of the same or different color, they may remain on as a steady light or as a flashing light. Additionally, an audible indicator may be included on the housing unit 11, to provide an audible indicator that various features of the device are operational. The audible indicator may be a small speaker that emits a buzz, or a tone, or any other appropriate audible sound. In the preferred embodiment, both the visual indicator and the audible indicator are activated whenever the emergency retraction function of the device is activated; this provides sensory assistance to the location of the wearer of the device. Other optional features are also contemplated.

To use the retractable leg irons 10, each of the cuffs 16,17 is placed around a leg of the wearer and then locked, so that the wearer cannot remove the cuffs 16,17 without unlocking the cuffs 16,17. One end of each cable 14,15 is permanently affixed to the cuffs 16,17. A swivel may be interposed between the end of a cable and a cuff to provide better mobility to the wearer in normal operating mode. The opposite end of each cable 14,15 is attached to a winch drum 12,13 which is mounted within the housing unit 11. The operator then sets the device to the normal operating mode using the remote control 30. In the normal operating mode, the winch drums 12,13 are free to rotate and so the wearer is able to move around with little resistance as the cables 14,15 freely extend and retract through the apertures 41 on the ends of the housing unit 11. The cables 14,15 freely extend and retract by coiling and uncoiling around the winch drums 12,13 which rotate freely in the normal operating mode.

In the embodiment using a single cable 140, each of the cuffs 16,17 is placed around a leg of the wearer and then locked, so that the wearer cannot remove the cuffs 16,17 without unlocking the cuffs 16,17. One end of the cable 140 is permanently affixed to one cuff A swivel may be interposed between the end of the cable and the cuff to provide better mobility to the wearer in normal operating mode. The opposite end of the cable 140 is attached to a winch drum which is mounted within the housing unit 110. The other cuff is attached to the housing unit 110. A swivel may be interposed between the housing unit and the cuff to provide better mobility to the wearer in normal operating mode. The operator then sets the device to the normal operating mode using the remote control 30. In the normal operating mode, the winch drum is free to rotate and so the wearer is able to move around with little resistance as the cable 140 freely extends and retracts through the aperture in the housing unit 110. The cable 140 freely extends and retracts by coiling and uncoiling around the winch drum which rotates freely in the normal operating mode.

In the embodiment using a single cable 240 and two housing units 210,212, each of the cuffs 16,17 is placed around a leg of the wearer and then locked, so that the wearer cannot remove the cuffs 16,17 without unlocking the cuffs 16,17. One cuff is attached to the first housing unit 210 and the other cuff is attached to the second housing unit 212. A swivel may be interposed between each housing unit 210,212 and the attached cuff to provide better mobility to the wearer in normal operating mode. One end of the cable 240 is attached to the winch drum located in the first housing unit 210 and the other end of the cable 240 is attached to the winch drum located in the second housing unit 212. The operator then sets the device to the normal operating mode using the remote control 30. In the normal operating mode, the winch drums are free to rotate and so the wearer is able to move around with little resistance as the cable 240 freely extends and retracts through the apertures in the housing units 210,212. The cable 240 freely extends and retracts by coiling and uncoiling around the winch drums which rotate freely in the normal operating mode.

Should it become necessary to restrict the movement of the wearer, the operator presses the emergency activation button 33. A signal is sent from the transmitter 31 which is received by the sensor 40. The sensor 40 communicates the signal to the control unit 18, which then activates the emergency mode of the device. When the emergency mode is activated an optional indicator light 39 on the remote control 30 may light up and the control unit 18 activates the servomotors 22,23 which rotate the winch drums 12,13 to retract the cables 14,15. The cables 14,15 are retracted until the cuffs 16,17 rest against the apertures 41 at the ends of the housing unit 11. When the cables 14,15 are fully retracted the winch drums 12,13 are locked into place; the shortened length of the cables 14,15 restricts the movement of the wearer's legs.

Alternatively, there may be a need to fix the length of the device without resorting to activating the emergency mode. That is, perhaps a shortened length is desired to partially impede the movement of the wearer. In such a scenario, the cables 14,15 are extended only part way out of the housing unit 11, and then the cables 14,15 are locked into place. This can be accomplished by activating the lock function from the remote control unit 30. No retraction of the cables 14,15 takes place when the lock function is initiated, but the winch drums 12,13 are locked and no longer able to rotate. Once this function is no longer desired, an unlock instruction is sent by the remote control unit 30 to unlock the winch drums 12,13 and place the device into normal operating mode.

Should additional means be necessary to stop the wearer of the device, the operator may enable the shock mode by pressing the shock power button 35. This enables the shock feature of the device so that a high voltage electrical current can be applied to the wearer when needed. Should the shock become necessary, the operator presses the emergency shock button 36. So long as the emergency shock button 36 is held down an electrical current is administered to the wearer through the cables 14,15 and the cuffs 16,17. The remote control 30 tracks the amount of time the emergency shock button 36 is held down and stores the times so that they may be reviewed in the future.

In an alternate embodiment, the remote control 30 provides a digital display 32. The digital display 32 shows relevant information about the device which may include the current voltage level for the shock mode, the most recent time data for the shock mode usage, whether the shock mode is enabled, or any other relevant information. The operator may adjust the voltage level of the electrical current used in shock mode by using the adjustment control buttons 37. The operator may reset the shock mode settings by pressing the reset button 38. When the reset button 38 is pressed the voltage level returns to the lowest setting and all stored time data is erased.

Once the wearer has been restrained and is ready to be transported again the operator can return the retractable leg irons 10 to the normal operating mode by holding the emergency activation button 33 for a predetermined amount of time. When the emergency activation button 33 is held long enough the indicator light 39 flashes twice and the transmitter 31 sends a signal to the sensor 40. The sensor 40 then communicates the signal to the control unit 18 which deactivates the servomotors 23,24 and unlocks the winch drums 12,13. The winch drums 12,13 are then free to rotate again, which allows the cables 14,15 to freely extend and retract.

The housing unit 11 and battery door 21 are preferably manufactured from a rigid, durable, and lightweight material such as magnesium alloy. The cables 14,15 and cuffs 16,17 are preferably manufactured from a durable material with high tensile strength such as galvanized steel. The cables 14,15 may be wire cables, flexible sheet metal straps, coated or uncoated with fabric or plastic coverings, or the like. The sensor window 20 is preferably manufactured from a transparent durable material such as bullet proof glass.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

We claim:

1. A retractable leg restraint device comprising a housing unit, a left cable, a right cable, a retraction means, a left cuff, a right cuff, and a remote control unit;

with the housing unit having a hollow interior, with a first aperture located at one end of the housing unit and allowing access into the hollow interior of the housing unit and a second aperture located at an opposite end of the housing unit and allowing access into the hollow interior of the housing unit;

the left cable being a flexible, elongate member having a first end and a second end;

the right cable being a flexible, elongate member having a first end and a second end;

the retraction means being located within the hollow interior of the housing unit, with the first end of the left cable being attached to the retraction means such that the retraction means is capable of drawing at least a portion of the left cable into the hollow interior of the housing unit through the first aperture, and the first end of the right cable being attached to the retraction means such that the retraction means is capable of drawing at least a portion of the right cable into the hollow interior of the housing unit through the second aperture;

the left cuff being configured to be placed around a portion of a left human leg, with the left cuff attached to the second end of the left cable, the left cuff having a locked mode and an unlocked mode, whereby while in the unlocked mode the left cuff may be placed around and removed from the portion of the left human leg and while in the locked mode the left cuff cannot be removed from the portion of the left human leg if the left cuff has been placed around the portion of the left human leg;

the right cuff being configured to be placed around a portion of a right human leg, with the right cuff attached to the second end of the right cable, the right cuff having a locked mode and an unlocked mode, whereby while in the unlocked mode the right cuff may be placed around and removed from the portion of the right human leg and while in the locked mode the right cuff cannot be removed from the portion of the right human leg if the right cuff has been placed around the portion of the right human leg; and the remote control unit being in wireless communication with the housing unit and being capable of sending one or more signals to the housing unit such that upon receipt of at least one of the one or more signals the housing unit causes the retraction means to draw at least a portion of the left cable into the hollow interior of the housing unit and to draw at least a portion of the right cable into the hollow interior of the housing unit.

2. The retractable leg restraint device of claim 1 wherein the retraction means comprises a left winch drum and a right winch drum, wherein the left winch drum is positioned within the hollow interior of the housing unit and is capable of rotating in a first winding direction and in a second unwinding direction, whereby the first end of the left cable is attached to the left winch drum, and when the left winch drum rotates in the first winding direction the left cable is coiled onto the left winch drum, and when the left winch drum rotates in the second unwinding direction the left cable is uncoiled from the left winch drum; and the right winch drum is positioned within the hollow interior of the housing unit and is capable of rotating in a first winding direction and in a second unwinding direction, whereby the first end of the right cable is attached to the right winch drum, and when the right winch drum rotates in the first winding direction the right cable is coiled onto the right winch drum, and when the right winch drum rotates in the second unwinding direction the right cable is uncoiled from the right winch drum;

whereby the retraction means has a normal operating mode and a locked mode, wherein when the retraction means is in the normal operating mode the left winch drum is free to rotate in the first winding direction and in the second unwinding direction, and the right winch drum is free to rotate in the first winding direction and in the second unwinding direction; and when the retraction means is in the locked mode the left winch drum does not rotate and the right winch drum does not rotate.

3. The retractable leg restraint device of claim 2 wherein the retraction means further comprises a first servomotor and a second servomotor, wherein the first servomotor is in connection with the left winch drum and is capable of rotating the left winch drum in the first winding direction to coil the left cable around the left winch drum, and the second servomotor is in connection with the right winch drum and is capable of rotating the right winch drum in the first winding direction to coil the right cable around the right winch drum.

4. The retractable leg restraint device of claim 3 wherein the remote control unit comprises a transmitter, and the housing unit further comprises a sensor and a control unit, with the transmitter of the remote control unit being capable of wirelessly sending one or more distinct signals to the sensor, the sensor being capable of receiving the one or more distinct signals from the transmitter, and the control unit being in communication with the sensor and the retraction means;

whereby when the sensor receives one or more distinct signals from the transmitter the sensor communicates the one or more distinct signals to the control unit, and when the control unit receives one or more distinct signals from the sensor the control unit operates the retraction means.

5. The retractable leg restraint device of claim 4 wherein at least one of the one or more distinct signals sent by the transmitter is a retract instruction, whereby upon the sensor receiving the retract instruction from the transmitter the sensor communicates the retract instruction to the control unit, and when the control unit receives the retract instruction from the sensor the control unit causes the first servomotor to rotate the left winch drum in the first winding direction to coil the left cable around the left winch drum, and causes the second servomotor to rotate the right winch drum in the first winding direction to coil the right cable around the right winch drum, until substantially all of the left cable is coiled around the left winch drum and the left cuff is adjacent to the first aperture of the housing unit, and substantially all of the right cable is coiled around the right winch drum and the right cuff is adjacent to the second aperture of the housing unit, and the retraction means is placed into locked mode.

6. The retractable leg restraint device of claim 4 wherein at least one of the one or more distinct signals sent by the transmitter is a lock instruction, whereby upon the sensor receiving the lock instruction from the transmitter the sensor communicates the lock instruction to the control unit, and when the control unit receives the lock instruction from the sensor the control unit locks the left winch drum and locks the right winch drum and places the retraction means into locked mode.

7. The retractable leg restraint device of claim 4 wherein at least one of the one or more distinct signals sent by the transmitter is an unlock instruction, whereby upon the sensor receiving the unlock instruction from the transmitter the sensor communicates the unlock instruction to the control unit, and when the control unit receives the unlock instruction from the sensor the control unit unlocks the left winch drum and the right winch drum and places the retraction means into normal operating mode.

8. The retractable leg restraint device of claim 1 further comprising a battery pack, with the battery pack capable of powering the retraction means.

9. The retractable leg restraint device of claim 8 wherein the battery pack is located within the hollow interior of the housing unit, is comprised of rechargeable batteries, and the housing unit comprises a charging port providing access to the rechargeable batteries.

10. The retractable leg restraint device of claim 9 wherein the left cable, the right cable, the left cuff, and the right cuff are made of electrically conductive material, and the battery pack is capable of generating an electrical current that passes through the left cable, the right cable, the left cuff, and the right cuff; and the remote control unit further comprises a shock switch, said shock switch capable of being manipulated by a user, such that when the shock switch is manipulated by the user the remote control unit sends a distinct signal which is a shock instruction, and when the shock instruction is received the battery pack generates an electrical current which passes through the left cable, the right cable, the left cuff, and the right cuff.

11. The retractable leg restraint device of claim 10 wherein the remote control unit further comprises a recording device, said recording device capable of recording a duration of time corresponding to the manipulation of the shock switch by the user.

12. The retractable leg restraint device of claim 11 wherein the remote control unit further comprises a display, such that the duration of time corresponding to the manipulation of the shock switch by the user can be perceived by the user.

13. The retractable leg restraint device of claim 10 wherein the remote control unit further comprises an intensity switch, said intensity switch capable of being manipulated by the user, such that when the intensity switch is manipulated by the user the remote control unit sends one or more distinct signals which indicate an intensity of electrical current to be generated by the battery pack when the shock switch is manipulated by the user.

14. The retractable leg restraint device of claim 13 wherein the remote control unit further comprises a display, such that the intensity of electrical current selected by manipulation of the intensity switch by the user can be perceived by the user.

15. The retractable leg restraint device of claim 1 wherein the left cuff is made of a high tensile strength material and the right cuff is made of a high tensile strength material.

16. The retractable leg restraint device of claim 1 wherein the left cuff is retained in locked mode by a pawl locking mechanism, and the right cuff is retained in locked mode by a pawl locking mechanism.

17. The retractable leg restraint device of claim 1 wherein the left cable is a metal wire cable, and the right cable is a metal wire cable.

18. The retractable leg restraint device of claim 1 wherein the left cable is a thin sheet metal strap, and the right cable is a thin sheet metal strap.

19. The retractable leg restraint device of claim 1 wherein the left cable is encased within a covering, and the right cable is encased within a covering, with said covering of the left cable being one of the group of a fabric covering and a durable plastic polymer covering, and with said covering of the right cable being one of the group of a fabric covering and a durable plastic polymer covering.

20. The retractable leg restraint device of claim 2 wherein the left winch drum comprises a first biasing mechanism that rotates the left winch drum in the first winding direction, and the right winch drum comprises a second biasing mechanism that rotates the right winch drum in the first winding direction;

whereby in the absence of tension on the left cable the first biasing mechanism rotates the left winch drum in the first winding direction, and in the absence of tension in the right cable the second biasing mechanism rotates the right winch drum in the first winding direction.

21. The retractable leg restraint device of claim 20 wherein the first biasing mechanism comprises one or more torsion springs, each of the one or more torsion springs being in connection with the left winch drum, and the second biasing mechanism comprises one or more torsion springs, each of the one or more torsion springs being in connection with the right winch drum.

22. The retractable leg restraint device of claim 1 wherein the retraction means comprises a central winch drum, wherein the central winch drum is positioned vertically within the hollow interior of the housing unit and is capable of rotating in a first winding direction and in a second unwinding direction, whereby the first end of the left cable is attached to the central winch drum and the first end of the right cable is attached to the central winch drum, and when the central winch drum rotates in the first winding direction the left cable is coiled onto the central winch drum and the right cable is coiled onto the central winch drum, and when the central winch drum rotates in the second unwinding direction the left cable is uncoiled from the central winch drum and the right cable is uncoiled from the central winch drum;

whereby the retraction means has a normal operating mode and a locked mode, wherein when the retraction means is in the normal operating mode the central winch drum is free to rotate in the first winding direction and in the second unwinding direction, and when the retraction means is in the locked mode the central winch drum does not rotate.

23. A retractable leg restraint device comprising a first housing unit, a second housing unit, a cable, a first retraction means, a second retraction means, a first cuff, a second cuff, and a remote control unit;

with the first housing unit having a hollow interior, with an aperture located at one end of the first housing unit and allowing access into the hollow interior of the first housing unit;

the second housing unit having a hollow interior, with an aperture located at one end of the second housing unit and allowing access into the hollow interior of the second housing unit;

the cable being a flexible, elongate member having a first end and a second end;

the first retraction means being located within the hollow interior of the first housing unit, with the first end of the cable being attached to the first retraction means such that the first retraction means is capable of drawing at least a portion of the cable into the hollow interior of the first housing unit through the aperture of the first housing unit;

the second retraction means being located within the hollow interior of the second housing unit, with the second end of the cable being attached to the second retraction means such that the second retraction means is capable of drawing at least a portion of the cable into the hollow interior of the second housing unit through the aperture of the second housing unit;

the first cuff being configured to be placed around a portion of a first human leg, with the first cuff attached to the first housing unit at a location opposite the aperture of the first housing unit, the first cuff having a locked mode and an unlocked mode, whereby while in the unlocked mode the first cuff may be placed around and removed from the portion of the first human leg and while in the locked mode the first cuff cannot be removed from the portion of the first human leg if the first cuff has been placed around the portion of the first human leg;

the second cuff being configured to be placed around a portion of a second human leg, with the second cuff attached to the second housing unit at a location opposite the aperture of the second housing unit, the second cuff having a locked mode and an unlocked mode, whereby while in the unlocked mode the second cuff may be placed around and removed from the portion of the second human leg and while in the locked mode the second cuff cannot be removed from the portion of the second human leg if the second cuff has been placed around the portion of the second human leg; and the remote control unit being in wireless communication with the first housing unit and with the second housing unit, and being capable of sending one or more signals to the first housing unit and to the second housing unit, such that upon receipt of at least one of the one or more signals the first housing unit causes the first retraction means to draw at least a portion of the cable into the hollow interior of the first housing unit, and the second housing unit causes the second retraction means to draw at least a portion of the cable into the hollow interior of the second housing unit.

24. The retractable leg restraint device of claim 23 wherein the first retraction means comprises a first winch drum, and the second retraction means comprises a second winch drum;

wherein the first winch drum is positioned vertically within the hollow interior of the first housing unit and is capable of rotating in a first winding direction and in a second unwinding direction, whereby the first end of the cable is attached to the first winch drum, and when the first winch drum rotates in the first winding direction the cable is coiled onto the first winch drum, and when the first winch drum rotates in the second unwinding direction the cable is uncoiled from the first winch drum; and the second winch drum is positioned vertically within the hollow interior of the second housing unit and is capable of rotating in a first winding direction and in a second unwinding direction, whereby the second end of the cable is attached to the second winch drum, and when the second winch drum rotates in the first winding direction the cable is coiled onto the second winch drum, and when the second winch drum rotates in the second unwinding direction the cable is uncoiled from the second winch drum;

whereby the first retraction means has a normal operating mode and a locked mode, wherein when the first retraction means is in the normal operating mode the first winch drum is free to rotate in the first winding direction and in the second unwinding direction, and when the first retraction means is in the locked mode the first winch drum does not rotate; and the second retraction means has a normal operating mode and a locked mode, wherein when the second retraction means is in the normal operating mode the second winch drum is free to rotate in the first winding direction and in the second unwinding direction, and when the second retraction means is in the locked mode the second winch drum does not rotate.

25. The retractable leg restraint device of claim 24 wherein the first retraction means further comprises a first servomotor, and the second retraction means further comprises a second servomotor;

wherein the first servomotor is in connection with the first winch drum and is capable of rotating the first winch drum in the first winding direction to coil the cable around the first winch drum; and the second servomotor is in connection with the second winch drum and is capable of rotating the second winch drum in the first winding direction to coil the cable around the second winch drum.

26. The retractable leg restraint device of claim 24 wherein the first winch drum comprises a first biasing mechanism that rotates the first winch drum in the first winding direction and the second winch drum comprises a second biasing mechanism that rotates the second winch drum in the first winding direction;

whereby in the absence of tension on the cable the first biasing mechanism rotates the first winch drum in the first winding direction and the second biasing mechanism rotates the second winch drum in the first winding direction.

* * * * *